US006497625B2

(12) United States Patent
Newby

(10) Patent No.: US 6,497,625 B2
(45) Date of Patent: Dec. 24, 2002

(54) APPARATUS AND METHOD FOR RETURNING A GOLF BALL TO A DESIRED LOCATION

(76) Inventor: Richard W. Newby, 75712 Easy St., Palm Desert, CA (US) 92211

( * ) Notice: Subject to any disclaimer, the term of this patent is extended or adjusted under 35 U.S.C. 154(b) by 0 days.

(21) Appl. No.: 09/764,652

(22) Filed: Jan. 16, 2001

(65) Prior Publication Data

US 2002/0094877 A1 Jul. 18, 2002

(51) Int. Cl.[7] ..... A63B 59/06
(52) U.S. Cl. ..... 473/163; 473/166; 473/191
(58) Field of Search ..... 473/157–163, 473/166, 181, 182, 183, 184, 191, 194, 135, 168–170; 273/121 R, 121 D, 122 R, 122 A, 119 B, 124 R, 125 R, 127 C, 129 AP

(56) References Cited

U.S. PATENT DOCUMENTS

| | | | | | |
|---|---|---|---|---|---|
| 3,378,263 | A | * | 4/1968 | Turnau et al. | 124/51.1 |
| 3,561,765 | A | | 2/1971 | Dixon et al. | 273/177 |
| 3,567,223 | A | * | 3/1971 | Gentiluomo | 473/135 |
| 3,580,583 | A | | 5/1971 | Gentiluomo | 273/176 |
| 3,620,536 | A | | 11/1971 | Lau | 273/176 A |
| 3,706,452 | A | | 12/1972 | Soucie | 273/35 |
| 3,856,313 | A | | 12/1974 | Tierney | 273/176 |
| 3,874,665 | A | | 4/1975 | McCulloch et al. | 273/34 |
| 4,156,526 | A | | 5/1979 | Huggins et al. | 273/78 |
| 4,272,078 | A | | 6/1981 | Vinette | 273/182 |
| 4,611,809 | A | | 9/1986 | Gettelfinger | 273/176 |
| 5,018,731 | A | | 5/1991 | Doyle | 273/35 |
| 5,102,141 | A | * | 4/1992 | Jordan | 473/163 |
| 5,129,653 | A | | 7/1992 | Morris et al. | 273/179 |
| 5,165,690 | A | | 11/1992 | Kelley, Jr. | 273/179 |
| 5,301,947 | A | | 4/1994 | Kim | 273/176 |
| 5,393,053 | A | | 2/1995 | Wiese et al. | 273/34 |
| 5,505,451 | A | | 4/1996 | Brayshaw | 273/176 |
| 5,529,304 | A | | 6/1996 | Wood | 473/163 |
| 5,738,593 | A | * | 4/1998 | Coury et al. | 473/135 |
| 5,816,928 | A | | 10/1998 | Colonna | 473/229 |
| 5,855,522 | A | | 1/1999 | Bevan | 473/160 |
| 5,916,033 | A | * | 6/1999 | Doherty | 473/135 |
| 6,120,383 | A | * | 9/2000 | Brown | 473/135 |

OTHER PUBLICATIONS

Ad: "Electronic Putting Challenge," Item No. 3691, Frontgate catalog 800–626–6488 or www.Frontgate.com, p. 23, and The Wall Street Journal, Jun. 10, 1999, p. A23.

Ad: "Challenger Putting System 2000," Item No. C222943, Brookstone catalog, 1–800–351–7222 or www.brookstone.com, p. 17.

Ad: "Motorized Ultimate Home Putting Game," Item No. B–20731–688593, Damark catalog, 800–827–6767 or www.damark.com, p. 50.

* cited by examiner

*Primary Examiner*—Mark S. Graham
(74) *Attorney, Agent, or Firm*—Loudermilk & Associates

(57) ABSTRACT

A golf putting green and associated ball return system are disclosed. The ball return system returns a ball generally to the original point of the putt. As a ball is hit and rolls into a target hole or gutter, it falls by gravity through an air gate and enters an air duct channel. The gate closes after the ball falls through it. A gutter is provided for missed putts. The gutter slopes to a hole that also includes an air gate, which momentarily opens to allow missed putt balls to enter the air duct channel. Using the force of air generated by an air producing unit, the ball is gently propelled through the channel, which extends uprange along the putting surface, and returns the ball at the end of the channel onto the putting area. As the ball exits the channel with momentum generated by the airflow, it follows along a curved frame structure, positioned around the periphery of one side edge of the putting area, which acts to deliver the ball to the point of the original putt. Counters may be included for detected made putts, missed putts, and total putts, etc.

26 Claims, 4 Drawing Sheets

APPARATUS AND METHOD FOR RETURNING A GOLF BALL TO A DESIRED LOCATION

FIELD OF THE INVENTION

The present invention relates to games involving balls such as golf, and more particularly to a golf putting system with an associated ball return system, and yet more particularly to systems and methods for returning a golf ball to a desired location from a desired location utilizing a controlled and adjustable air flow.

BACKGROUND OF THE INVENTION

The game of golf has become increasingly popular in the United States and around the world. To remain competitive and improve performance, golfers constantly practice their game. There is a need in the field for more opportunities for golfers to practice their game without the associated time and expense involved in physically practicing at a golf course or range. In particular, there is a need for implements to enable golfers to practice putting repetitively yet in a short amount of time.

Various devices have been developed or proposed in order to allow persons to practice golf. While these devices have taken a variety of configurations, they typically consist of features such as a hitting surface, target hole(s) and sometimes a ball return system. Conventional ball return systems have, for example, employed gravity through the use of automatic or manually inclined surfaces and channels. Other conventional systems have contemplated or utilized a golf ball ejector or pressurized fluid chamber to return balls to a holding tank or another location. The shortcomings associated with these systems include the relatively long time delay from the time of hitting the ball towards the target hole and the ball's return to the golfer. In addition, the ball is returned in a manner that still requires the golfer to physically move to retrieve or re-position the ball for the next putt.

Furthermore, while conventional systems have included or proposed ball returns that return a ball, either to a holding tank or another area, there is a need for an improved system that can return the ball to the point of origin of the putt. With such a system, the golfer need not retrieve the ball nor change his or her original stance, grip, or posture, and can maintain more complete concentration without interruption after a putt. As an example, it is believed that conventional systems cannot provide a means for a golfer to hit at least 100 putts at a target hole such as in 8–10 minutes. Such repetitive putting practice is believed to significantly aid in the development of a smooth, predictable and repeatable putting stroke that can improve the accuracy and consistency of the golfer's putting.

SUMMARY OF THE INVENTION

The present invention provides an apparatus and methods for returning a putted ball to the hitting area after the ball is hit into the hole or into a gutter, thereby allowing the golfer to repeatedly hit the ball numerous times in a period of minutes without requiring a change in his/her physical position (e.g., without requiring movement of the feet, etc., in order to retrieve the ball, etc.).

As a ball is hit and rolls into a target hole, or past the hole and into a gutter which is sloped and includes a second hole, the ball falls through a membrane gate into a channel of an air duct system. As the ball falls through either hole, a membrane air gate is provided that momentarily opens and then closes after the ball falls through it. Using the force of air generated by an air producing unit, such as one or multiple fans, the ball is gently propelled in the channel, which extends uprange (or downrange) along the putting surface and ultimately returning the ball generally to the point of origin. The ball exits the channel with momentum caused by the airflow onto the putting area and preferably follows along a curved frame structure positioned at the periphery of at least one side of the putting area, which acts to deliver the ball to the point of the original putt and preferably in the direction to be putted. The amount of air flow through the channel, the length, and the curvature of the frame structure preferably may be adjusted for speed and aiming in order to return the ball to a desired location.

Balls that do not fall into the target hole may fall into the gutter positioned behind or in whole or part around but spaced apart from the target hole for missed putts. The gutter preferably is inclined to deliver the ball through a hole that delivers the ball to the same air duct channel as the target hole and preferably returns the ball by the same airflow through the channel. The putting surface in preferred embodiments is variable in length and may be covered by artificial grass, fabric, carpet, or smooth material depending on the type of surface a golfer wishes to have simulated. It preferably may also be adjusted to provide either a true and straight putting surface, or may be contoured by the use of lobes or thumbscrews or the like in order to provide a curved or breaking surface, and also provide for various inclination levels to allow for a change in the speed and difficulty of the putt.

Accordingly, an object of the present invention is to provide a putting green or surface, which may be stationary.

Another object of the present invention is to provide a putting green or surface, which may be portable in the example of a lightweight reduced size travel model.

Another object of the present invention is to provide a putting green or surface with foldable hinges along the surface for easy storage or with a cabinet for the putting green or surface to fold into.

Another object of the present invention is to provide a putting green or surface, which may be used outdoors.

Another object of the present invention is to provide a putting green or surface, which may be used indoors in the example of a fold-down model to be built into a home or a collapsible model for a hotel room or office.

Another object of the present invention is to provide a putting green or surface, which is extendable, for example, up to at least 16 feet.

Another object of the present invention is to provide an adjustable mechanism so that the putting surface may be adjusted for a faster or slower roll.

Another object of the invention is to provide an adjustable mechanism so that the putting surfaces may be adjusted to be flat and true or may be varied into a contoured surface and/or with adjustable incline levels.

Another object of the invention is to have more than one target hole.

Another object of the invention is to allow for a target hole to be reduced in size in an effort to enhance the accuracy of the putt.

Another object of the invention is to provide a coin operated industrial model of the golf putting green or surface such as for recreational parks.

Finally, it is an object of the present invention is to provide a preferably electronic score keeper or counter that detects balls putted versus putts attempted or may also assign different scores based on different positions on the green or surface.

BRIEF DESCRIPTION OF THE DRAWINGS

The above objects and other advantages of the present invention will become more apparent by describing in detail the preferred embodiments of the present invention with reference to the attached drawings in which.

DETAILED DESCRIPTION OF THE PREFERRED EMBODIMENTS

The present invention will be described in greater detail with reference to certain preferred and certain other embodiments, which may serve to further the understanding of preferred embodiments of the present invention. As described elsewhere herein, various refinements and substitutions of the various elements of the various embodiments are possible based on the principles and teachings herein.

Figure 1:
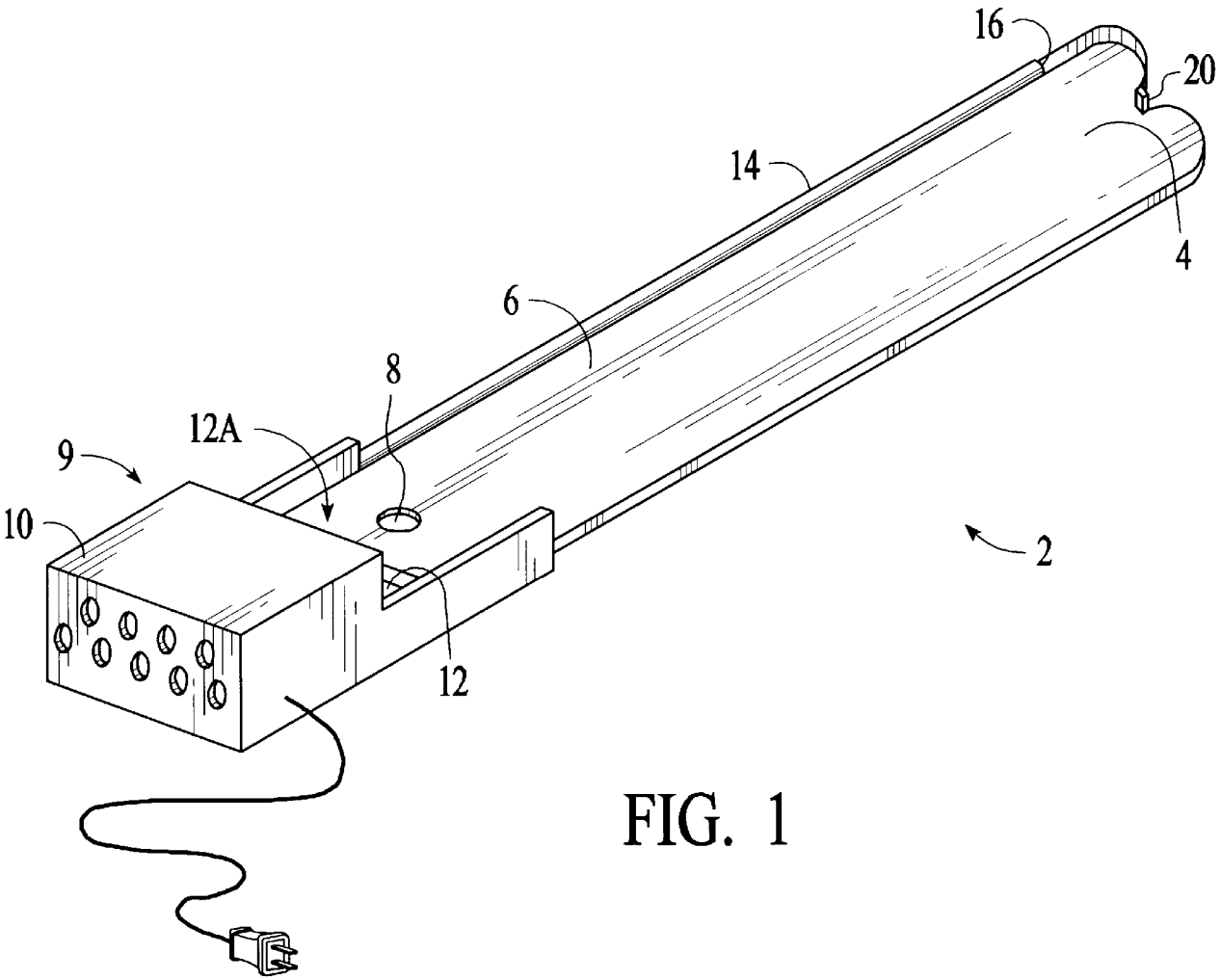
FIG. 1 is a perspective view of a golf putting green and system in accordance with a preferred embodiment of the present invention.

FIG. 1 illustrates a golf putting green or surface, generally denoted as reference number 2, in accordance with a preferred embodiment of the present invention. Golf putting green 2 is illustrated as generally consisting of three subdivisions or portions: putting subdivision 4, at the uprange end of putting green 2, upon which the golfer putting a ball hits the ball; directly downrange of putting subdivision 4 is putting surface 6 over which the ball rolls after being struck by the putter; target subdivision 6, directly downrange of putting subdivision 4 and putting surface 6, which contains target hole 8 into which the golfer is attempting to putt the ball; and a ball return air system, generally denoted as reference number 9, positioned preferably behind target hole 8, which operates to return a ball that has fallen into target hole 8 or has fallen into gutter 12 for missed balls, which preferably is positioned spaced apart from, but behind and/or around, target hole 8. Housing 10 protects and houses ball return air system 9 and preferably is positioned directly behind gutter 12 and target hole 8 as illustrated. Gutter 12 also includes a hole through which balls for missed putts may enter the air duct ball return system, which preferably drops the missed putt balls into a common channel as with balls that go into target hole 8.

Figure 2:
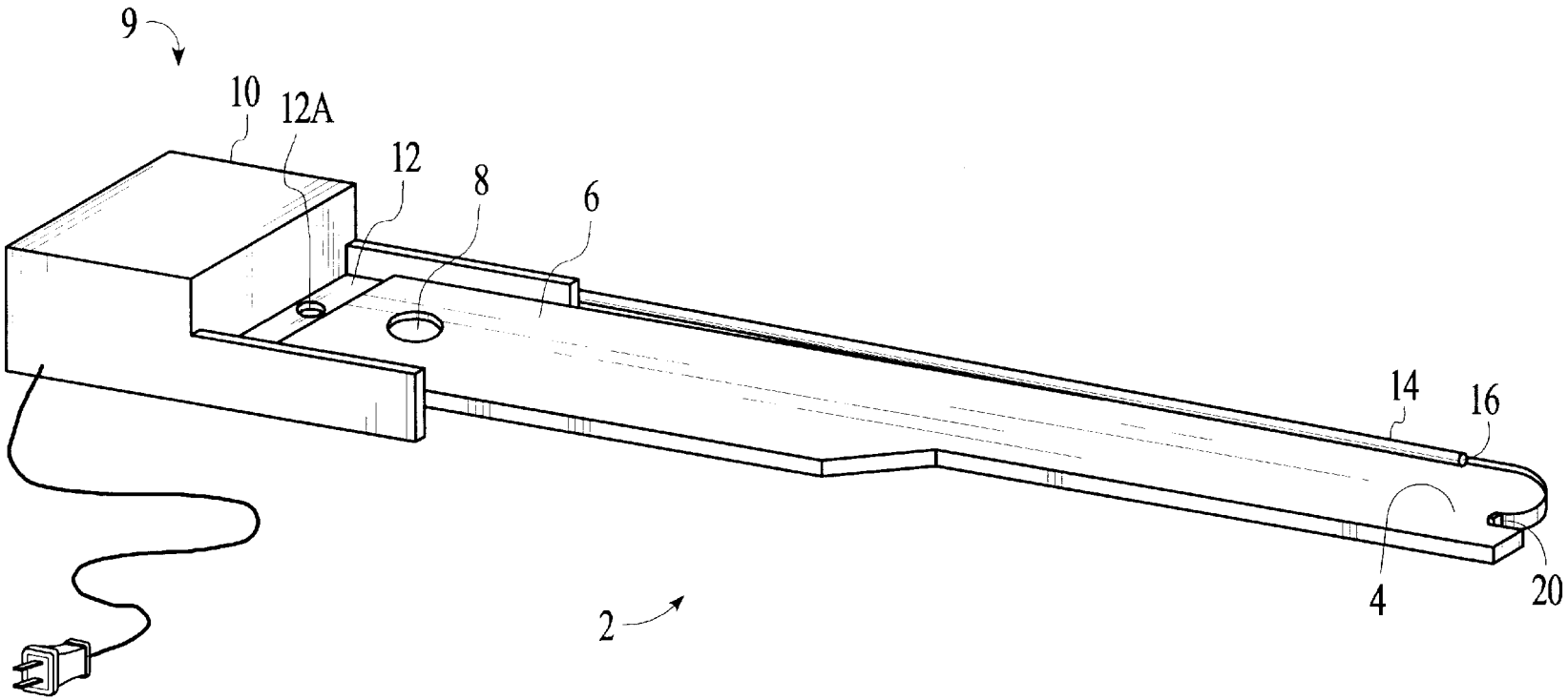
FIG. 2 is another perspective view of a golf putting green and system in accordance with a preferred embodiment of the present invention.

With references to FIGS. 1 and 2, preferred and certain alternative embodiments of the present invention will be further described. Golf putting green 2 preferably includes air duct channel 14, which preferably is substantially in the shape of a tube, and preferably circular in cross section or otherwise has a curved lower surface through which the balls may be channeled. Among the important considerations are that channel 14 channel air flow from the beginning points of the air duct return system, i.e., where a ball falls through target hole 8 or the hole in gutter 12, and down the length of putting green 2, while also providing a low resistance and stable channel for the ball to return to its point of origin. As perhaps can best be viewed in FIG. 2, channel 14 extends uprange, perpendicular from ball return air system 9 and parallel to the putting green surface, stopping at putting subdivision 4. Channel 14 preferably is made of a durable material, such as PVC or other plastic material (and may be transparent), or may be metallic or other material suitable for providing an air and ball return channel. Channel 14 includes opening 16 for returning a golf ball onto putting subdivision 4.

With continued reference to FIG. 2, golf putting green 2 includes peripheral frame structure 18. Frame structure 18 preferably extends to a height one or several inches above putting subdivision 4 and is formed and positioned to curve around the periphery of one side edge of putting subdivision 4, in single "U" (such as illustrated in FIG. 2) or double "U" shape (such as illustrated in FIG. 1). As a ball exits opening 16, it is directed to roll along "U" shaped frame structure 18, looping around to return the ball to approximately the place of the original putt. Golf putting green 2 preferably includes adjuster 20, which in general is preferably positioned directly across from target hole 8 and centrally located on putting subdivision 4, preferably at the farthest central point of frame structure 18 as illustrated. Adjuster 20, for example, may be adjusted manually and positioned in various directions to assist the golfer in controlling the final location of the returned golf ball. For example, in a preferred embodiment adjuster 20 may be a block that is positioned with a thumb screw or the like that spreads or contracts the end portions of the two ends of the two U portions of frame structure 18 (or at the one end of a single U frame structure, etc.), which serves to direct the golf ball to a center portion of the putting surface or other desired portion, or towards either edge of the putting surface. Through the use of adjuster 20, a golfer may desirably control the final position of the returned golf ball.

It should also be noted in FIG. 2 that the putting surface near the points where the putter may wish to stand preferably includes a tapered portion, which desirably may allow the golfer to stand a desired, close position relative to the ball to be putted. It also should be noted that, with an adjustable air flow, the putter may stand at any of a variety of locations along the putting surface, and the adjustments provided by the system (such as described herein) returning the ball to the desired location; i.e., close to where the putter is located.

Figure 3:
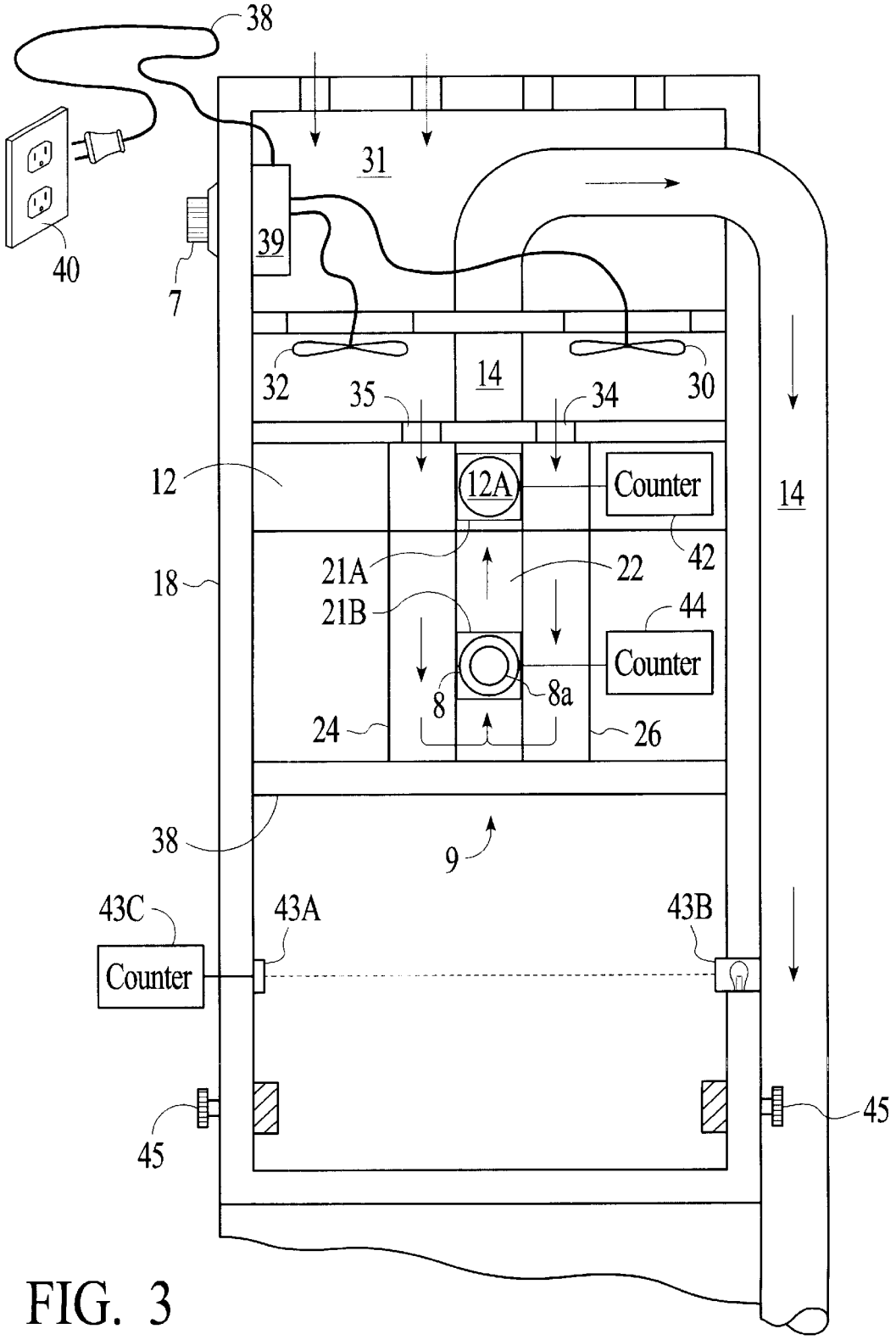
FIG. 3 is a diagram illustrating additional details of an airflow, channel/duct system of a ball return system in accordance with a preferred embodiment of the present invention.

Referring now to FIG. 3, ball return system 9 in accordance with a first preferred embodiment of the present invention will now be described. Ball return system 9 includes air producing unit 31, which preferably includes one or two or other number of air producing units, such as one or more conventional fans. Air intake holes preferably are provided in a rear wall or other surface of a housing for the air production unit such as are illustrated. In the illustrated embodiment, two fans 30 and 32 are symmetrically positioned with respect to a lengthwise center axis of the overall putting surface. In accordance with preferred embodiments, two modest sized fans have been found to provide sufficient and reasonably balanced air flow with fans that are commercially available, and reasonably low powered and relatively quiet during operation (one fan is used in alternate embodiments, preferably with only a right or left channel 24 or 26, etc., utilized to channel air into the system). Air producing unit 31 is powered by electricity from electric cord 38, which connects to power outlet 40 or other suitable source of power, such as a battery and/or solar or other power producing devices/systems. In the illustrated preferred embodiment, fans 30 and 32 of air producing unit 31 generate airflow of about 0.23–0.27 pounds/square inch (psi) and blows air continuously in the illustrated first direction through two longitudinal channels 24 and 26 via inlets 35 and 34. The airflow preferably is deflected against horizontal back board 38 into center channel 22, which is positioned immediately underneath target hole 8 and gutter hole 12A of gutter 12, causing the air to flow in the illustrated second direction through center channel 22, flowing opposite the first direction. Center channel serves to guide the ball through center channel 22 and into channel 14.

As will be appreciated, a putted golf will fall through target hole 8 or gutter hole 12A by gravity through one of gates 21 A or 21 B, each of which preferably consists of a membrane, trap door or other implement to normally block air from existing the duct system, while enabling a golf ball to drop through the hole into center channel 22. Gate 21A or 21B momentarily opens to enable the ball to enter the duct system and then closes after the ball falls through it so as to prevent loss of air from the duct system and to maintain more uniform airflow in the channels. The ball is gently propelled by the airflow from the second direction through center channel 22, and the ball then enters channel 14, returning the ball with sufficient, air-controlled momentum to desirably return the ball to a generally predetermined location, such as a position on putting subdivision 4 where the putt was originally struck. Channel 14 preferably curves to an angle to extend directly uprange along the putting surface to where the ball exits via opening 16 at the end of channel 14 onto to putting subdivision 4 at the desired location. As will be appreciated, through appropriate control of air producing unit 31, such as through variable AC power controller 39 (or other suitable means for adjusting the amount of air produced by air producing unit 31, such as by one or more speed control switches for the one or more fans, etc.), the rate of air flow may be controlled, which thereby controls the amount of force/energy imparted to the golf ball to be returned, which thereby (in conjunction with frame structure 18 and adjuster 20, etc.) controls the final general position of the returned golf ball.

FIG. 3 also illustrates contour adjusters 45 (which may be implemented with lobes or thumbscrews, etc.), which preferably are located on both sides of the putting surface as illustrated, and which serve to raise (or lower) one side relative to the other side, such that the surface is now contoured or uneven. With such contour adjusters, the putting surface preferably may be adjusted to provide either a true and straight putting surface (i.e., if the contour adjusters are at the same height or level), or may be contoured to provide a curved or breaking surface, and also provide for various inclination levels to allow for a change in the speed and difficulty of the putt. The putting surface, as will be appreciated, is constructed of a material to accommodate a slight twist or flex in order to accommodate the uneven contour, and may be a material such as MDF (or other type of particle or fiber board), plexiglass, etc.

Figure 4:
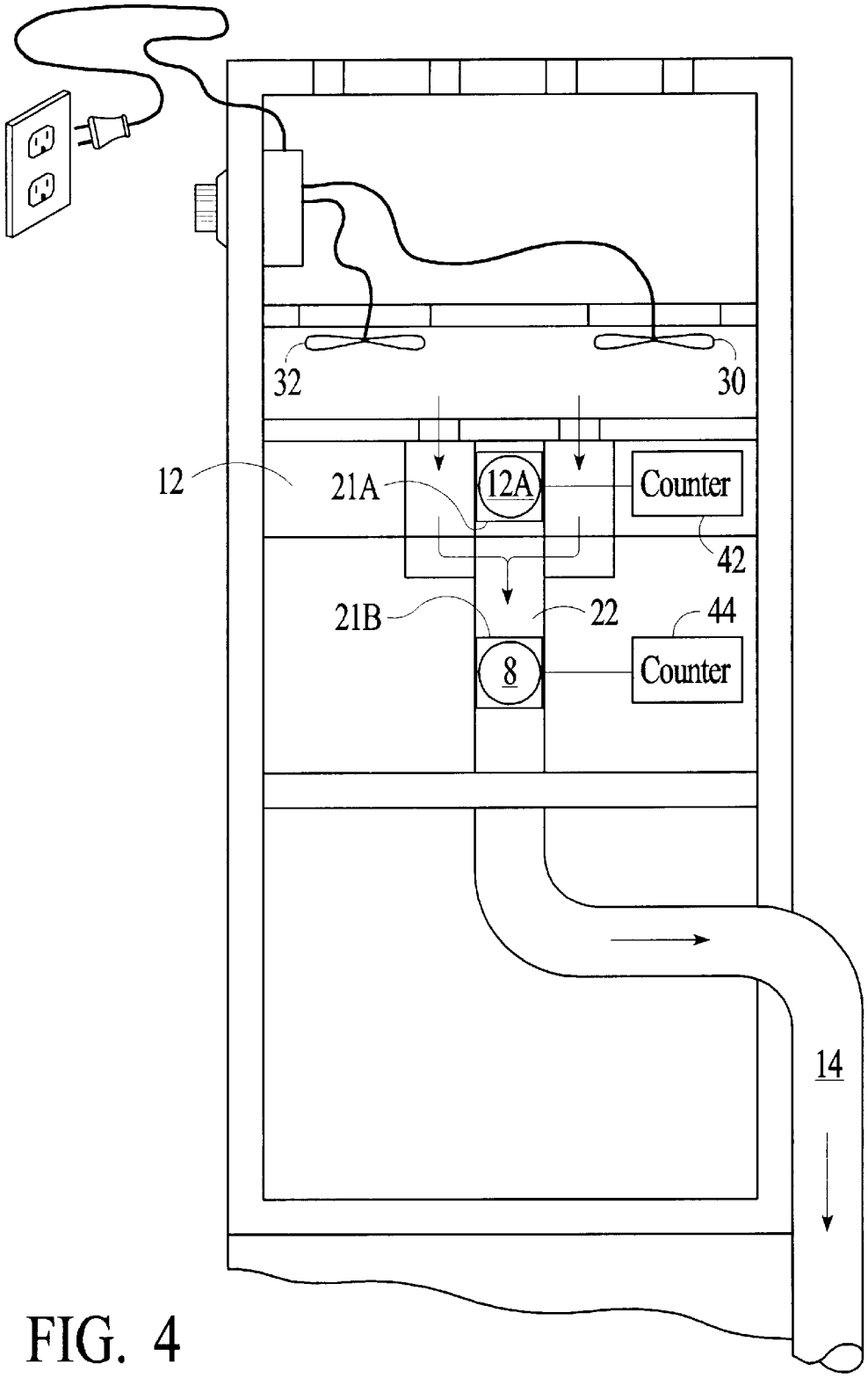
FIG. 4 is another diagram illustrating additional details of an airflow, channel/duct system of a ball return system in accordance with an additional preferred embodiment of the present invention.

With reference to FIG. 4, another preferred embodiment of the present invention is illustrated. In accordance with this embodiment, air producing unit 31 generates air, such as with fan 30 (and/or fan 32 as illustrated; again, one, two or more fans may be utilized in accordance with the present invention), preferably blowing in the first direction uprange into channel 22. A ball that drops by gravity into target hole 8 or gutter hole 12A through one of gates 21A or 21B into channel 22 and is gently propelled through channel 22. Channel 22 curves in a preferably 90 (or other) degree angle to join or become channel 14, wherein the ball is propelled uprange to the end of the channel 14 to exit onto putting subdivision 4. After the ball exits, it may follow along curved frame structure 18 and returns to the place of the original putt, such as previously described.

In further reference to FIGS. 3 and 4, in preferred embodiments two score counters 42 and 44, which desirably may be utilized to detect the number of missed putts versus the putts made, number of total putts, etc. Counter 42 preferably is attached to, or positionally corresponding to, gate 21 A and/or target hole 8, and detects the number of putts made. Counter 44 preferably is attached to, or positionally corresponding to, gate 21B and/or gutter hole 12A, ate of gutter 12, and detects the number of putts missed. Counters 42 and 44 preferably are powered by a suitable electrical power source (such as via electricity from electric cord 38, connecting to power outlet 40, which may be through an AC-DC converter or other suitable power supply or power conversion implementation), or may be powered with a battery or solar power or other source. Each such counter includes, or is coupled to, a preferably numeric display, preferably lighted, to indicate the count number (e.g., made or missed putts, etc.). In yet other embodiments, a counter 43C is coupled to a light source 43A/sensor 43B combination, which provides a light beam from a source to a sensor that is interrupted by a ball traveling towards target hole 8. In such embodiments, a ball traveling toward target hole 8 interrupts the light beam between the source and sensor, thereby providing an indication of total putts, which would include putts that are hit but do not enter either target hole 8 or gutter 12, etc.; for example, to account for putts that do not make it all the way (i.e., hit too softly) or hit two hard and bounce back, etc. As will be appreciated, counters and associated displays may be conventionally wired, coupled together and configured, such as under common microprocessor control, to provide counts of total putts, made putts, and/or missed putts, which may be accompanied by a display of elapsed time, real time or the like. In yet other alternative embodiments, counters for two players may be included, such that total putts made in a predetermined elapsed time (preferably displayed on a display) may be counted, etc.

Based on the foregoing, alternative embodiments are contemplated by the present invention. For example, the channel arrangement of the preferred embodiments are exemplary. What is important is that an air producing unit provide air flow that is coupled to a channel into which made or missed balls may drop, and the channel returns the ball (at least in part moved by the preferably adjustable air flow) to the desired location. For example, the channel could return the ball by having the channel (for example) curve slightly onto the putting surface and having an exit that allows the ball to roll/return to the desired location (i.e., rolling opposite from the putting direction). More than one target hole could be provided, with each target hole allowing the ball to drop into a common or separate channel, which receives input air from the air production unit and channels the ball into a return channel. The double U frame structure, such as in FIG. 1, could accommodate right and left handed golfers, such as by having a return channel that can be switched from one side to the other (for example, return channel 14 could be rotated or removed/replaced such that it then extends down the left side of the putting surface; switch 7 in FIG. 3 could be positioned high enough to accommodate the side-switching of the return channel, etc.). In general, the number and type of fans or other air production unit(s) may be selected based on cost, manufacturability, noise and similar constraints, provided that they (in conjunction with the air duct system, frame, rolling surface, etc.) provide sufficient air flow to return the ball to the desired location, and preferably are adjustable to accommodate different lengths, adjustment for changing the of desired location, aging of the fans or rolling surface, etc. Also, in other embodiments, such as in the square portion of the frame adjacent to the single U frame of FIG. 2, a ball "reservoir" or storage location may be provided, which may be accompanied by a vertically extending loop (for example) of a rigid but non-abrasive material into which the "toe" of a putter may be inserted, so that the golfer may rest the putter such as at the end of the practice session or during a break, etc. Also, while not expressly shown, a coin operation mechanism may be provided, which is coupled preferably to the air production system and any provided counters and displays, such that the unit may be operated for predetermined times based on coins inserted into the coin operation mechanism. In addition, the target hole may be configured so as to accommodate a "hole reducer," which basically may be an insert that may fit over the target hole so as to reduce its effective size, in order to make the putt more difficult. Such refinements and alternatives are expressly within the scope of the present invention.

Although the invention has been described in conjunction with specific preferred and other embodiments, it is evident that many substitutions, alternatives and variations will be apparent to those skilled in the art in light of the foregoing description. Accordingly, the invention is intended to embrace all of the alternatives and variations that fall within the spirit and scope of the appended claims. For example, it should be understood that, in accordance with the various alternative embodiments described herein, various systems, and uses and methods based on such systems, may be obtained. The various refinements and alternative and additional features also described may be combined to provide additional advantageous combinations and the like in accordance with the present invention. Also as will be understood by those skilled in the art based on the foregoing description, various aspects of the preferred embodiments may be used in various subcombinations to achieve at least certain of the benefits and attributes described herein, and such subcombinations also are within the scope of the present invention. All such refinements, enhancements and further uses of the present invention are within the scope of the present invention.

What is claimed is:

1. A ball return apparatus, comprising:

a hitting and rolling surface including a first area in which a ball is struck and a second area that includes a target hole and a gutter that is spaced apart from and at least partially behind the target hole, wherein a struck ball may enter the target hole or may miss the target hole and enter the gutter, wherein the gutter includes a second hole into which a struck ball that enters the gutter may enter;

an air production unit that generates airflow; and an air channel system that receives a ball that enters the target hole or the gutter, wherein the air channel system includes at least one air inlet for receiving airflow from the air production unit and a channel that extends along a length of the hitting and rolling surface and an outlet that returns the ball that entered the target hole or gutter to the first area of the hitting and rolling surface.

2. The apparatus of claim 1, further comprising a first air gate, wherein a ball that enters the target hole passes through the first air gate prior to entering the air channel system, wherein the first air gate opens momentarily to allow the ball to enter the air channel system but at other times inhibits airflow from the air channel system through the target hole.

3. The apparatus of claim 2, wherein the first air gate comprises a membrane, flap or trap door.

4. The apparatus of claim 1, further comprising a second air gate, wherein a ball that enters the gutter passes through the second air gate prior to entering the air channel system, wherein the second air gate opens momentarily to allow the ball to enter the air channel system but at other times inhibits airflow from the air channel system through the second hole.

5. The apparatus of claim 4, wherein the second air gate comprises a membrane, flap or trap door.

6. The apparatus of claim 1, wherein the air production unit comprises one or more fans.

7. The apparatus of claim 1, wherein the air production unit generates air pressure in a chamber, wherein air from the chamber provides the airflow that enters the at least one air inlet of the air channel system.

8. The apparatus of claim 1, wherein the air production unit comprises first and second fans, wherein the air channel system has first and second inlets, wherein the first fan generates air pressure that provides airflow through the first inlet, wherein the second fan generates air pressure that provides airflow through the second inlet.

9. The apparatus of claim 8, wherein the first and second inlets communicate airflow through first and second entry channels of the air channel system, wherein the first and second entry channels communicate airflow into a common channel, wherein the ball that entered the target hole or gutter enters the common channel and is moved by the airflow from the first and second entry channels through the air channel system to the outlet of the air channel system.

10. The apparatus of claim 8, wherein the first and second fans generate air pressure in a chamber, wherein air from the chamber provides the airflow that enters the first and second inlets of the air channel system.

11. The apparatus of claim 10, wherein a separator is positioned in the chamber between the first and second fans.

12. The apparatus of claim 1, wherein the air production unit is adjustable, wherein adjustment of the air production unit adjusts the airflow entering the air channel system.

13. The apparatus of claim 12, wherein adjustment of the air production unit alters a location to which the ball rolls after leaving the outlet of the air channel system.

14. The apparatus of claim 12, wherein adjustment of the air production unit alters a speed at which the balls rolls after leaving the outlet of the air channel system.

15. The apparatus of claim 1, wherein the channel passes down a right or left side of the hitting and rolling surface, wherein the channel is switchable in order to be positioned on the right or left side of the hitting and rolling surface.

16. The apparatus of claim 1, wherein the target hole is of a first diameter, wherein a hole reducer having a hole of a second diameter is positioned over the target hole, wherein the first diameter is greater than the second diameter.

17. The apparatus of claim 1, wherein the ball leaves the outlet of the air channel system and moves around a frame structure that redirects a path of the ball towards a desired portion of the first area.

18. The apparatus of claim 1, wherein the hitting and rolling surface includes an edge that is raised, wherein the raised edge inhibits struck balls from rolling off of the hitting and rolling surface.

19. The apparatus of claim 1, wherein a first counter is positioned to count balls that enter the target hole.

20. The apparatus of claim 19, wherein a second counter is positioned to count balls that enter the second hole.

21. The apparatus of claim 20, further comprising a light source and sensor pair and a third counter, wherein balls rolling towards the target hole or gutter intercept light being transmitted between the source and sensor, wherein the third counter counts a number of balls struck.

22. The apparatus of claim 21, wherein one or more display devices are coupled to the first, second and/or third counters, wherein the one or more display devices display a number of made and missed and/or total putts.

23. The apparatus of claim 1, wherein the hitting and rolling surface includes a contour adjustment, wherein the contour of the hitting and rolling surface may be adjusted.

24. The apparatus of claim 19, wherein a display displays the number of balls entering the target hole and an indication of time.

25. The apparatus of claim 1, wherein the channel comprises a plurality of tubular sections, wherein the sections each have a first end and a second end, wherein a first end of one section and a second end of an adjacent section have diameters such that the first end of the one section fits inside the second end of the adjacent section.

26. The apparatus of claim 19, wherein a display displays the number of balls entering the target hole.

* * * * *